US010213037B2

(12) United States Patent
Madsen

(10) Patent No.: US 10,213,037 B2
(45) Date of Patent: Feb. 26, 2019

(54) CABINET DOOR HANGING RECIPE HOLDER

(71) Applicant: Robert William Madsen, Seattle, WA (US)

(72) Inventor: Robert William Madsen, Seattle, WA (US)

(73) Assignee: Robert W. Madsen, Seattle, WA (US)

( * ) Notice: Subject to any disclaimer, the term of this patent is extended or adjusted under 35 U.S.C. 154(b) by 0 days.

(21) Appl. No.: 15/469,570

(22) Filed: Mar. 26, 2017

(65) Prior Publication Data

US 2018/0271313 A1 Sep. 27, 2018

(51) Int. Cl.
*A47G 29/08* (2006.01)
*A47B 77/00* (2006.01)

(52) U.S. Cl.
CPC ..... *A47G 29/08* (2013.01); *A47B 77/00* (2013.01)

(58) Field of Classification Search
CPC ..... G09F 1/10; A47G 29/00; A47B 21/045; A47B 23/02; B42D 17/00; B42D 5/005
See application file for complete search history.

(56) References Cited

U.S. PATENT DOCUMENTS 3,168,276 A * 2/1965 Schneider ..... F16B 47/00 211/48
4,023,763 A * 5/1977 Pulley ..... B42D 17/00 116/240
D295,805 S * 5/1988 Stocker ..... D19/76
5,215,364 A * 6/1993 Moore ..... A47B 77/10 312/323
5,845,889 A * 12/1998 Suzuki ..... A47B 21/045 24/67.11
6,439,534 B1 * 8/2002 Hensel ..... A47J 47/16 248/301
7,124,988 B1 * 10/2006 Duffy ..... A47B 21/0314 108/40
7,228,653 B2 * 6/2007 Byrne ..... G09F 3/20 40/642.02
D747,610 S * 1/2016 Lohman ..... D6/326
9,611,979 B2 * 4/2017 Blair ..... F16M 13/022
2004/0049961 A1 * 3/2004 Byrne ..... G09F 3/20 40/649
2005/0269816 A1 * 12/2005 Huber ..... B42F 5/06 281/45
2008/0277359 A1 * 11/2008 St. Martin ..... A47K 10/04 211/16
2011/0267773 A1 * 11/2011 Macfarlane ..... G06F 1/1632 361/679.55
2013/0212898 A1 * 8/2013 Reynolds ..... G09F 1/10 34/239
2016/0106208 A1 * 4/2016 Kirkpatrick ..... A47B 71/00 211/85.4

* cited by examiner

*Primary Examiner* — Bradley Duckworth

(57) ABSTRACT

A recipe holder that temporarily hangs from the top of a cabinet door with a clip that adapts to a very wide variety of cabinet door edges and configurations. The recipe holder is adjustable in length to conform to the user's eye level and collapses for ease of storage. The holder has a spring clip at its lower end for holding sheets of paper or cards.

1 Claim, 2 Drawing Sheets

CABINET DOOR HANGING RECIPE HOLDER

FIELD OF INVENTION

The present invention relates to a cabinet door hung clipping device for holding recipes printed on sheets of paper or cards.

BACKGROUND OF THE INVENTION

The use of cookbooks is dropping due to access to new recipes and trends online. Online recipes are now being printed on individual sheets of paper or cards. The need to hold these in a visible location and off the counter or work space has become important for cooks and chefs.

BRIEF SUMMARY OF THE INVENTION

The present invention is generally directed toward the hanging of recipes from a clipping device that is configured to be temporarily attached to the top of kitchen cabinet doors, enabling the user to view a recipe at eye level keeping the recipe off the counter.

In one aspect of the present invention the top hooking device is designed to adapt to nearly all types of cabinet doors.

In another aspect of the present invention is a spring clamp at the bottom that sheet paper or card recipes can be attached.

The preferred embodiment of the present invention consists of a top hooking device and a bottom spring clamp connected by telescoping tubes that make the device adjustable in length for proper viewing height and collapsible for convenient storage.

BRIEF DESCRIPTIONS OF THE DRAWINGS

Figures 1, 2:
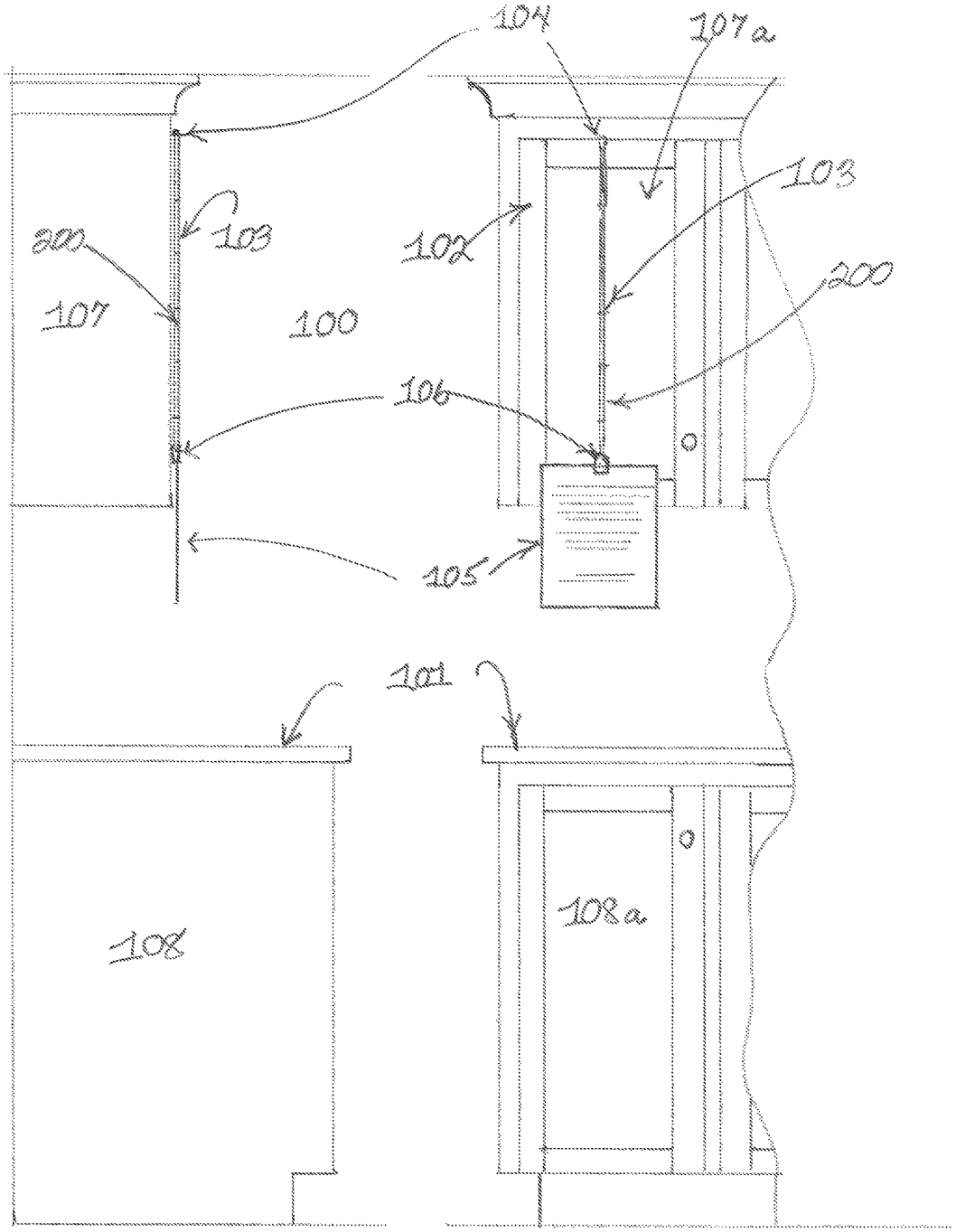

Preferred and alternative embodiment of the present invention are described below with reference to the following drawings;

FIG. 1 is a side elevation view of a typical residential kitchen. FIG. 2 is a front elevation view of an upper cabinet and a lower cabinet with the present invention hanging on the upper cabinet door.

Figure 4:
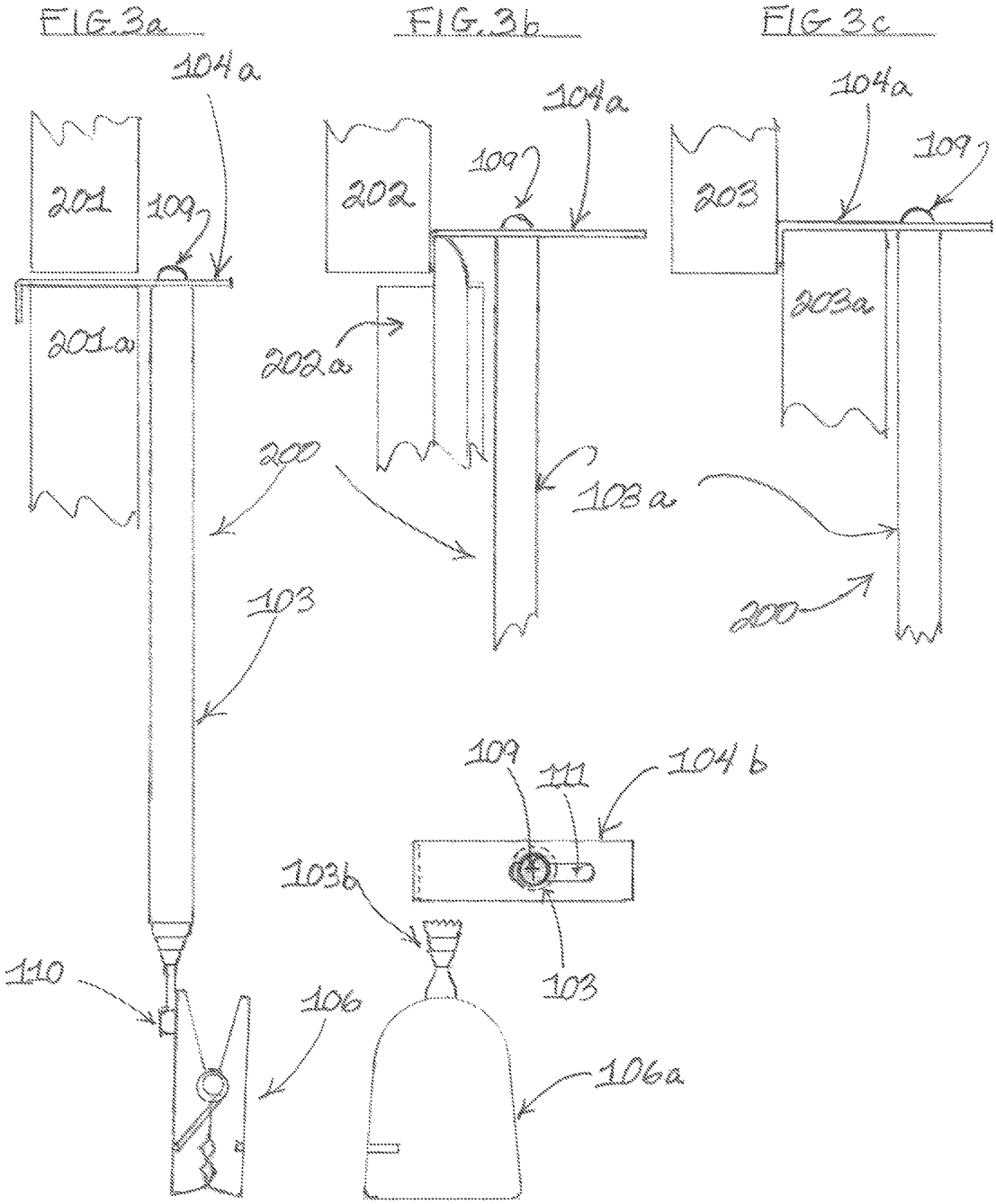

FIG. 3*a, b, c* illustrates the different types of cabinet doors that the invention can hang on, FIG. 4 illustrates the end components of the invention.

DETAILED DESCRIPTION OF THE INVENTION

FIG. 1 shows a typical residential kitchen 100 that has a side view of an upper cabinet 107 and a side view of an lower cabinet 108. FIG. 2 is a front view of an upper cabinet 107*a* and a front view of a lower cabinet 108*a*. The present invention 200 is hanging on the upper edge of the upper cabinet door 102. The invention 200 has telescoping tubes 103 extended to a typical length that enables the user to view the recipe 105 at a suitable eye level. The recipe 105 is attached to the invention by a spring clip 106 that is secured to the telescoping tubes 103. The invention hangs by a clip 104 that fits over the upper cabinet door 102.

FIGS. 1 & 2 further illustrates how the invention can hold a paper recipe 105 at eye level and keeps the work space or counter top 101 free of paper recipes that can be easily damaged by water or other cooking ingredients.

FIG. 3*a, b, c* illustrates the three most typical of all cabinet door edge configurations 201*a*, 202*a*, and 203*a* with the invention 200 hanging on each. Cabinet 201 has a full inset door 201*a* with a side view of the invention hanging clip 104*a* resting on the door 201*a*. The hanging clip 104 is adjustable by the set screw 109 to enable the invention to adapt to a wide variety of cabinet door edges. A top view of the hanging clip 104*b* illustrates the slot in the clip 111 that allows the clip to move to accommodate different cabinet door configurations and sizes. Cabinet door 202*a* has a lip edge with the invention 200 hanging by its clip 104*a* that has been adjusted so the partial view of the telescoping tubes 103*a* is closer to the cabinet door 202*a* for stability. Cabinet 203 has a full overlay door 203*a* that has the invention 200 hanging by its clip 104*a* and has also been adjusted by the set screw 109 to accommodate the doors configuration.

FIG. 4 further illustrates an embodiment of the present invention 200 with its adjustable hanging clip 104*a*. The clip is adjusted by the set screw 109 that is screwed into the telescoping tubes 103 that has a spring clip 106 that is secured to the end of the telescoping tubes 103 by a screw 110. The front view of the spring clip 106*a* illustrates the attachment to the partial view of the end of the telescoping tubes 103*b*.

FIGS. 3*a, b, c* illustrates that the preferred embodiment of the present inventions telescoping tubes 103 enable the device to be collapsed to a convenient size for storage and viewing heights.

While the preferred embodiment of the invention has been illustrated and described, many changes can be made without departing from the spirit and scope of the invention. Accordingly, the scope of the invention is not limited to the disclosure of the preferred embodiment. Instead the invention should be determined entirely by reference to the claims that follow.

The invention claimed is:

1. A cabinet door hanging recipe holder comprising;

an adjustable hanging clip having a slot, a telescoping tube having a fist end and a second end, a set screw connected to the first end, said set screw being received in the slot, and movable along the slot, a spring clip attached to the second end of the telescoping tube, wherein the adjustable hanging clip is configured to attach to the top edge of a cabinet door, and the spring clip is configured to receive and display a recipe.

* * * * *